US008313390B2

(12) United States Patent
Lu

(10) Patent No.: US 8,313,390 B2
(45) Date of Patent: Nov. 20, 2012

(54) INFANT SWING

(75) Inventor: Mulin Lu, Kowloon (HK)

(73) Assignee: BP Children's Products HK Co., Limited, Kwun Tong, Kowloon (HK)

( * ) Notice: Subject to any disclaimer, the term of this patent is extended or adjusted under 35 U.S.C. 154(b) by 213 days.

(21) Appl. No.: 12/782,719

(22) Filed: May 19, 2010

(65) Prior Publication Data

US 2010/0298057 A1 Nov. 25, 2010

Related U.S. Application Data

(60) Provisional application No. 61/179,705, filed on May 19, 2009.

(51) Int. Cl.
*A63G 9/02* (2006.01)
*A63G 9/12* (2006.01)

(52) U.S. Cl. ..... 472/118; 472/119

(58) Field of Classification Search ..... 472/118–125; 446/227; 297/273, 274; 5/101, 103
See application file for complete search history.

(56) References Cited

U.S. PATENT DOCUMENTS

| | | | | |
|---|---|---|---|---|
| 6,027,409 | A * | 2/2000 | Favorito et al. | 472/118 |
| 6,908,397 | B2 * | 6/2005 | Armbruster et al. | 472/119 |
| 7,252,594 | B2 * | 8/2007 | Armbruster et al. | 472/119 |
| 7,507,163 | B2 * | 3/2009 | Haut | 472/118 |

FOREIGN PATENT DOCUMENTS

| | | | |
|---|---|---|---|
| CA | 2 427 413 | A1 | 9/2004 |
| CN | 101254056 | A | 9/2008 |

* cited by examiner

*Primary Examiner* — Kien Nguyen
(74) *Attorney, Agent, or Firm* — Winston Hsu; Scott Margo

(57) ABSTRACT

An infant swing includes a holding frame, a hanger, and a supporting frame. The holding frame is used for holding a baby. The hanger is pivotally connected to the holding frame. The supporting frame is connected to an upper end of the hanger and extends along the contour of the holding frame from a side of the holding frame to another side, so that the supporting frame can support the holding frame on a holding surface cooperatively with the hanger.

22 Claims, 7 Drawing Sheets

INFANT SWING

CROSS REFERENCE TO RELATED APPLICATIONS

This application claims the benefit of U.S. Provisional Application No. 61/179,705, which was filed on May 19, 2009 and is incorporated herein by reference.

BACKGROUND OF THE INVENTION

1. Field of the Invention

The present invention relates to an infant swing, and more particularly, to an infant swing having an arc-shaped supporting frame.

2. Description of the Prior Art

A conventional infant swing is formed of a seat and a supporting frame respectively disposed on the left and right sides of the seat. By the structural design of the seat and the supporting frame, the infant swing can provide a front-to-rear swing, and it is accordingly allow the parents to pacify their baby via the front-to-rear swing of the infant swing. However, the said structural design is not only monotonous in swing direction, but the swing direction is also different from a mother's hug. Accordingly, the said structural design is not good at pacifying the baby.

Furthermore, since the conventional infant swing has a requirement of structural strength for the seat and the supporting frame, the shape of the conventional infant swing is more squarish and the supporting frame usually utilizes a straight-rod structure. Thus, the conventional infant swing is incompatible with the surroundings. Moreover, the straight-rod structure of the supporting frame, which is respectively disposed on the left and right sides of the seat, may block the parents' or the baby's sight so as to cause great inconvenience.

SUMMARY OF THE INVENTION

The present invention provides an infant swing comprising a holding frame for holding a baby; a hanger pivotally connected to the holding frame; and a supporting frame connected to an upper end of the hanger and extending along a contour of the holding frame from a side of the holding frame to another side, so as to support the holding frame on a holding surface cooperatively with the hanger.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
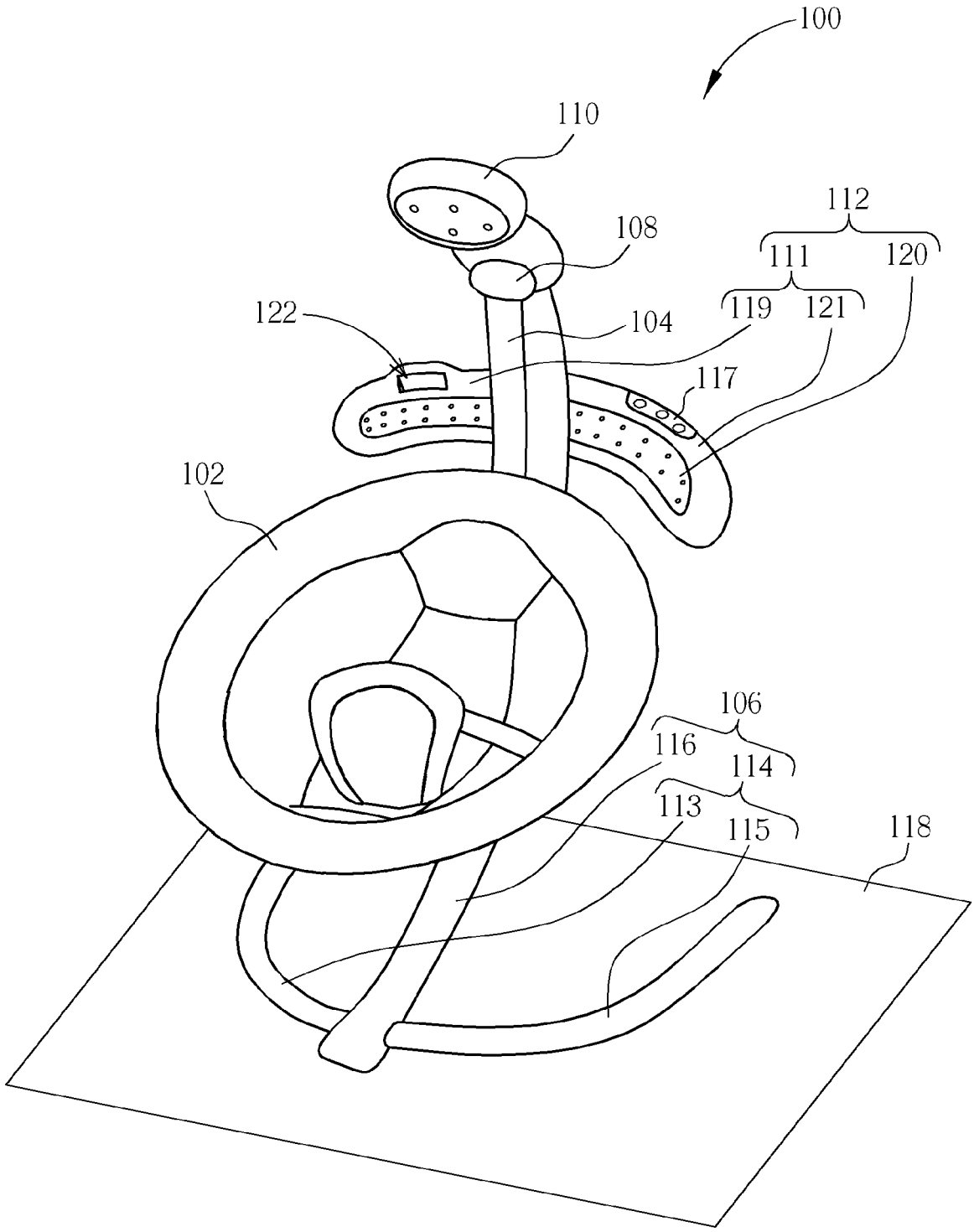
FIG. 1 is a diagram of an infant swing according to a first embodiment of the present invention.
Figure 2:
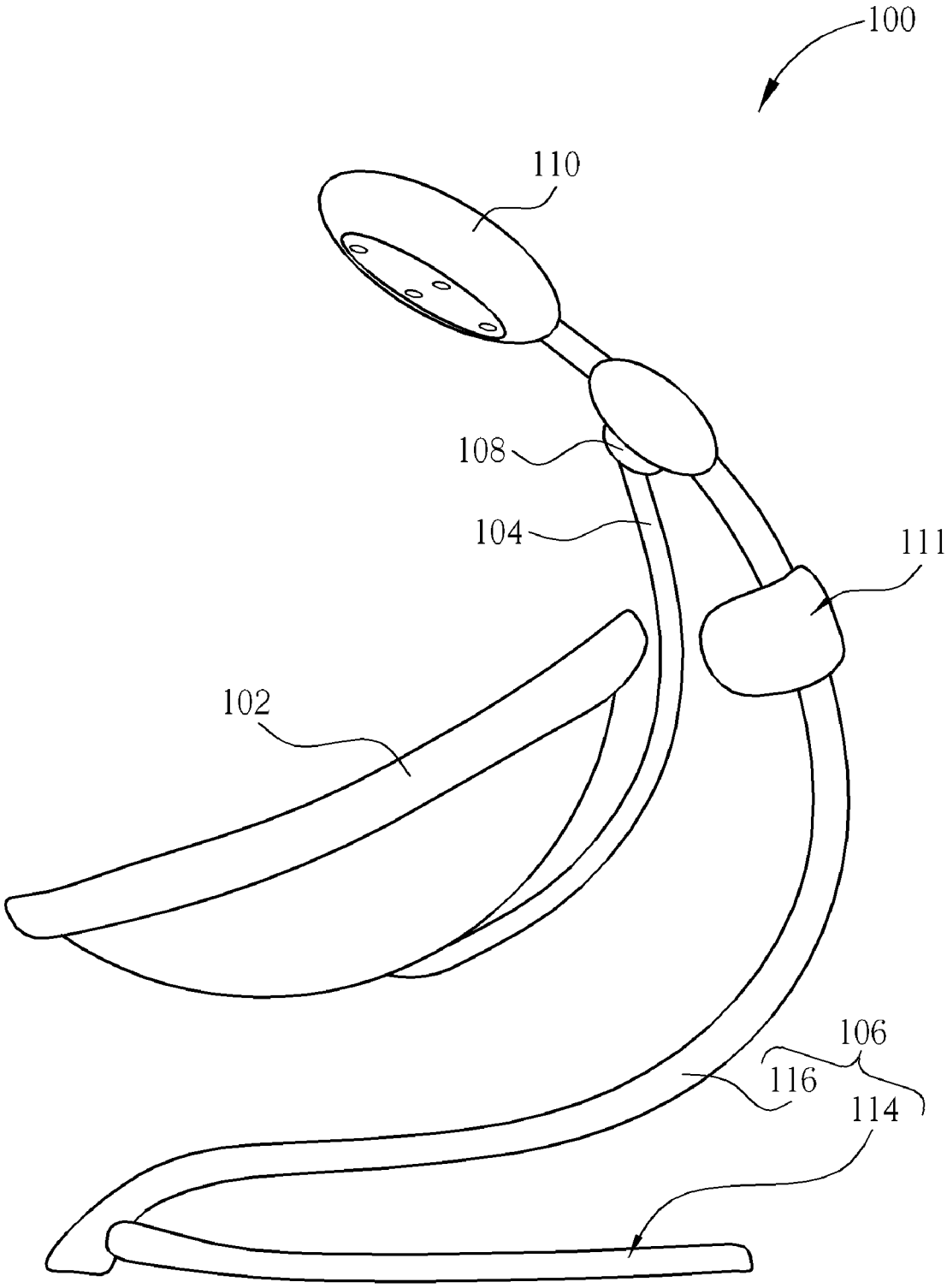
FIG. 2 is a side view of the infant swing in FIG. 1.

Please refer to FIG. 1, which is a diagram of an infant swing 100 according to a first embodiment of the present invention. As shown in FIG. 1, the infant swing 100 includes a holding frame 102, a hanger 104, a supporting frame 106, a driving device 108, a first auxiliary component 110, and a second auxiliary component 112. The holding frame 102 is used for holding a baby and is preferably an infant cradle or an infant seat. The hanger 104 is connected to the holding frame 102. In this embodiment, the hanger 104 is preferably an arc-shaped rod, and its bottom end is connected to a rear end of the holding frame 102 so that the holding frame 102 can extend forward along the curve of the arc-shaped rod. The supporting frame 106 includes a base 114 and an extending frame 116. A bottom end of the extending frame 116 is connected to the base 114 and opposite to the bottom end is pivotally connected to the hanger 104. The extending frame 116 bends from the base 114 along a contour of the holding frame 102 and the hanger 104. Thus, as shown in FIG. 2, which is a side view of the infant swing 100 in FIG. 1, the extending frame 116 can extend upward from a front side of the holding frame 102 to a rear side of the holding frame 102, so that an upper end of the extending frame 116 is disposed above the holding frame 102 and a position near its upper end is pivotally connected to an upper end of the hanger 104.

The base 114 includes two first foot portions 113 and 115, which extend backward from a left side and a right side of a front end of the extending frame 116 respectively. In such a manner, via assembly of the extending frame 116, the base 114, and the hanger 104, the infant swing 100 can support the holding frame 102 on a holding surface 118, wherein the holding surface 118 could be a ground or floor for placing the infant swing 100 on. In another embodiment, the two first foot portions 113 and 115 can integrally form a U-shaped structure, a middle portion of which is connected to the front end of the extending frame 116.

As shown in FIG. 1, the driving device 108 is disposed on a position where the extending frame 116 is pivotally connected to the hanger 104. The driving device 108 is used for driving the hanger 104 so as to make the holding frame 102 capable of swinging relative to the supporting frame 106. The related description for the driving device 108 is omitted herein since it is commonly seen in the prior art. If a user wants to make the holding frame 102 provide a different feeling of sitting to the baby, the user just needs to push the holding frame 102 to swing relative to the supporting frame 106. For example, in this embodiment, the driving device 108 can originally drive the holding frame 102 in FIG. 1 to swing leftward and rightward relative to the supporting frame 106, so as to make the holding frame 102 provide a feeling of sitting similar to a mother's hug. On the other hand, since the holding frame 102 is pivotally connected to the hanger 104, the user could make the holding frame 102 provide a feeling of swinging forward and backward to the baby by rotating the holding frame 102 leftward or rightward from the position as shown in FIG. 1 with an angle of 90 degree relative to the hanger 104. As a result, by driving of the driving device 108, the swinging direction of the holding frame 102 could be changed from leftward-and-rightward to forward-and-rearward, so as to provide a different feeling of sitting to the baby.

In this embodiment, a peripheral portion of the holding frame 102 forms as a ring-shaped structure which can provide the similar feeling of the parents' hug. A variety of toys can be disposed around the holding frame 102 so that the baby can touch them easily for attracting the baby's attention or allowing the baby to play with the toys conveniently.

In this embodiment, the first auxiliary component 110 may be a lighting device disposed on an upper end of the extending frame 116, that is, located above a position where the extending frame 116 is pivotally connected to the hanger 104. In other words, the lighting device is located above the holding frame 102 by the curve of the extending frame 116. Accordingly, the light effect of the lighting device can easily attract the baby's attention so as to pacify the baby. Furthermore, as shown in FIG. 1, the second auxiliary component 112 includes a wing part 111 and an audio device 120. The wing part 111 is disposed on a position of the extending frame 116 corresponding to an upper end of the holding frame 102, that is, below a position where the extending frame 116 is pivotally connected to the hanger 104. The wing part 111 includes two wing portions 119 and 120 extending from two sides of the extending frame 116, respectively. The audio device 120 is installed on the wing part 111. The audio device 120 provides sound for attracting the baby's attention or pacifying the baby, such as effect sound, baby music and so on. The parents can also use a functional button 117 on the wing part 111 to select music which they want to play.

In such a manner, since the position of the wing part 111 on the extending frame 116 is close to the holding frame 102, the purpose of attracting the baby's attention can be achieved more easily when the audio device 120 installed in the wing part 111 provides sound. Furthermore, a containing space 122 can be formed on the wing part 111. In this embodiment, the containing space 122 is preferably, but not limited to, formed on the wing portion 119 to provide a space for placing objects, so as to increase convenience of the infant swing 100 in use. The wing portion 119 can also be electrically connected to the audio device 120, so as to provide a music playback function when a portable music device (e.g. an MP3 player) is disposed in the containing space 122.

It should be mentioned that both the first auxiliary component 110 and the second auxiliary component 112 can be an omissible component for simplifying the structure design of the infant swing 100. Furthermore, the driving device 108 can also be an omissible component. In other words, the holding frame 102 could be swing by an active driving design that is driven via motor power, or by a passive driving design that is driven via manual operating.

In summary, via the curve design of the extending frame 116 along the contour of the holding frame 102 to extend upward from the front side of the holding frame 102 to the rear side of the holding frame 102, as well as the design which can selectively provide a swing direction of the baby sitting on the holding frame 102 at a leftward-and-rightward or a frontward-and-rearward, the infant swing 100 can not only provide the feeling of sitting similar to a mother's hug so as to make its entire structure more smooth to be compatible with the surroundings, but also enhance its convenience in use since the said problem of blocking the parents' or the baby's sight can be solved.

Figure 3:
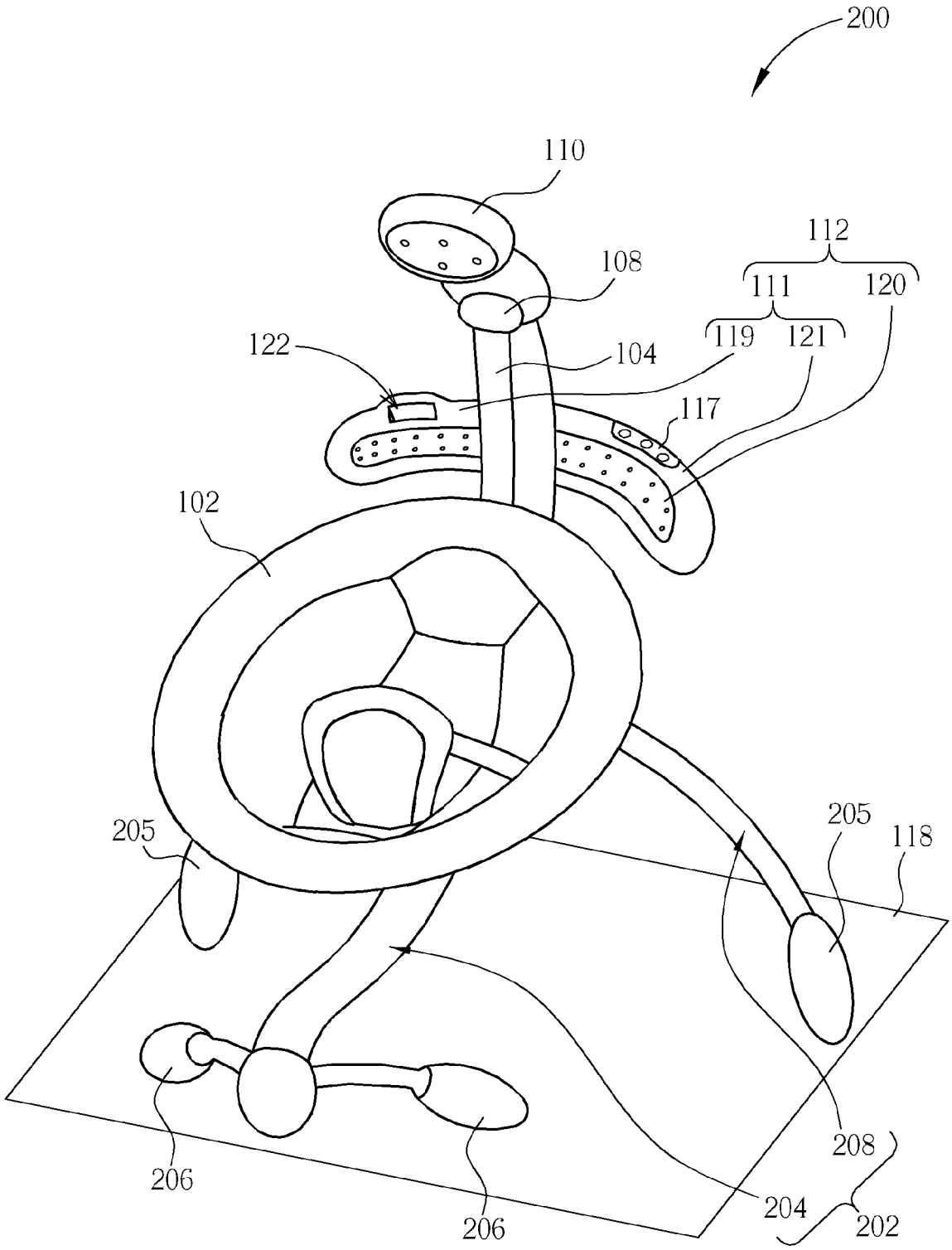
FIG. 3 is a diagram of an infant swing according to a second embodiment of the present invention.

Please refer to FIG. 3, which is a diagram of an infant swing 200 according to a second embodiment of the present invention. Components both mentioned in the second embodiment and the first embodiment represent components with similar functions or structures, and the related description is therefore omitted herein. The major difference between the infant swing 200 and the infant swing 100 is the structural design of the supporting frame.

As shown in FIG. 3, as the first embodiment, the infant swing 200 includes the holding frame 102, the hanger 104, the driving device 108, the first auxiliary component 110 and the second auxiliary component 112. However, the infant swing 200 includes a supporting frame 202 that includes an extending frame 204 and a base 208. As shown in FIG. 3, the extending frame 204 is connected to the base 208 and pivotally connected to the hanger 104, and bends along a contour of the holding frame 102 and the hanger 104. In other words, the extending frame 204 extends upward from the front side of the holding frame 102 to the rear side to be pivotally connected to the upper end of the hanger 104 at a position near its upper end. The base 208 is connected to a middle portion of the extending frame 204 which is located at the rear side of the holding frame 102. The base 208 includes two first foot portions 205 extending downward, respectively. In this embodiment, a front end of the extending frame 204 includes two second foot portions 206 extending leftward and rightward, respectively. As a result, the holding frame 102 can be supported on the holding surface 118 steadily by multiple-point support of the second foot portions 206 and the first foot portions 205.

Figure 4:
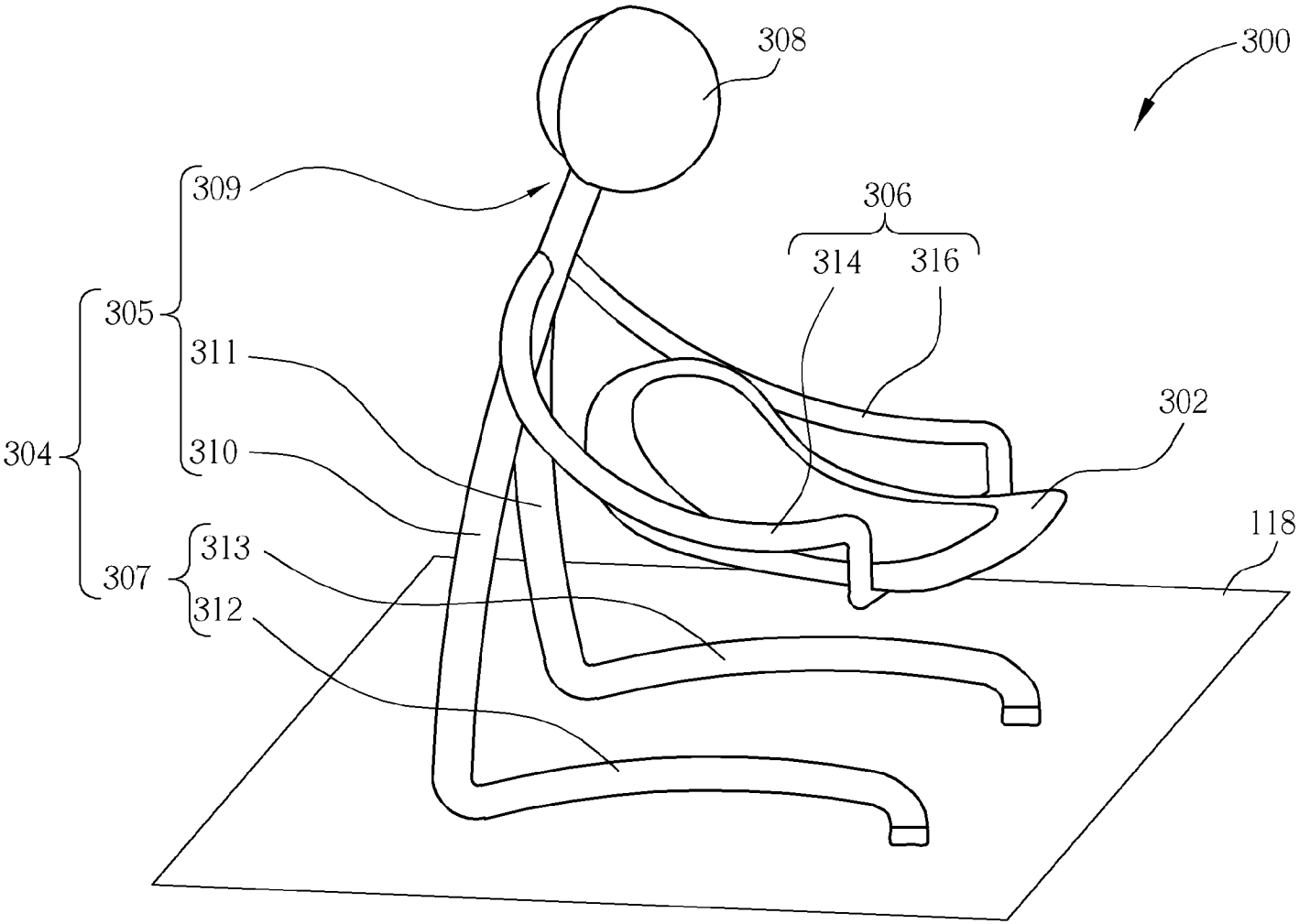
FIG. 4 is a diagram of an infant swing according to a third embodiment of the present invention.

Please refer to FIG. 4, which is a diagram of an infant swing 300 according to a third embodiment of the present invention. The infant swing 300 includes a holding frame 302, a supporting frame 304, a hanger 306 and a first auxiliary component 308. As mentioned above, the holding frame 302 is used for holding a baby, and is preferably an infant cradle or an infant seat. The supporting frame 304 includes an extending frame 305 and a base 307. The extending frame 305 is a reverse Y-shaped structure and includes a body portion 309 and two second foot portions 310 and 311 connected to a bottom end of the body portions 309. Two first foot portions 312 and 313 of the base 307 are connected to the corresponding second foot portions 310 and 311, respectively. In this embodiment, the second foot portion 310 and the corresponding first foot portion 312, as well as the second foot portion 311 and the corresponding first foot portion 313, integrally form an L-shaped structure, respectively. The hanger 306 includes a first arm 314 and a second arm 316. The first arm 314 and the second arm 316 are connected to two sides of a front end of the holding frame 302, respectively, and extend upward along a curve of the holding frame 302 to be pivotally connected to two sides of the supporting frame 304, respectively. Thus, the first arm 314 and the second arm 316 can support the holding frame 302 on the holding surface 118 cooperatively with the extending frame 305 and the base 307.

The first auxiliary component 308 is disposed on an upper end of the body portion 309 of the supporting frame 304. In this embodiment, the first auxiliary component 308 is an audio device and is located above the holding frame 302 by the extending curve of the supporting frame 304. As mentioned above, the audio device can provide sound for attracting the baby's attention or pacifying the baby, such as effect sound, baby music and so on. Furthermore, in addition to dispose of the first auxiliary component 308, an extra auxiliary component capable of pacifying a baby can also be disposed on the body portion 309, such as toys or the lighting device mentioned in the said embodiment.

Figure 5:
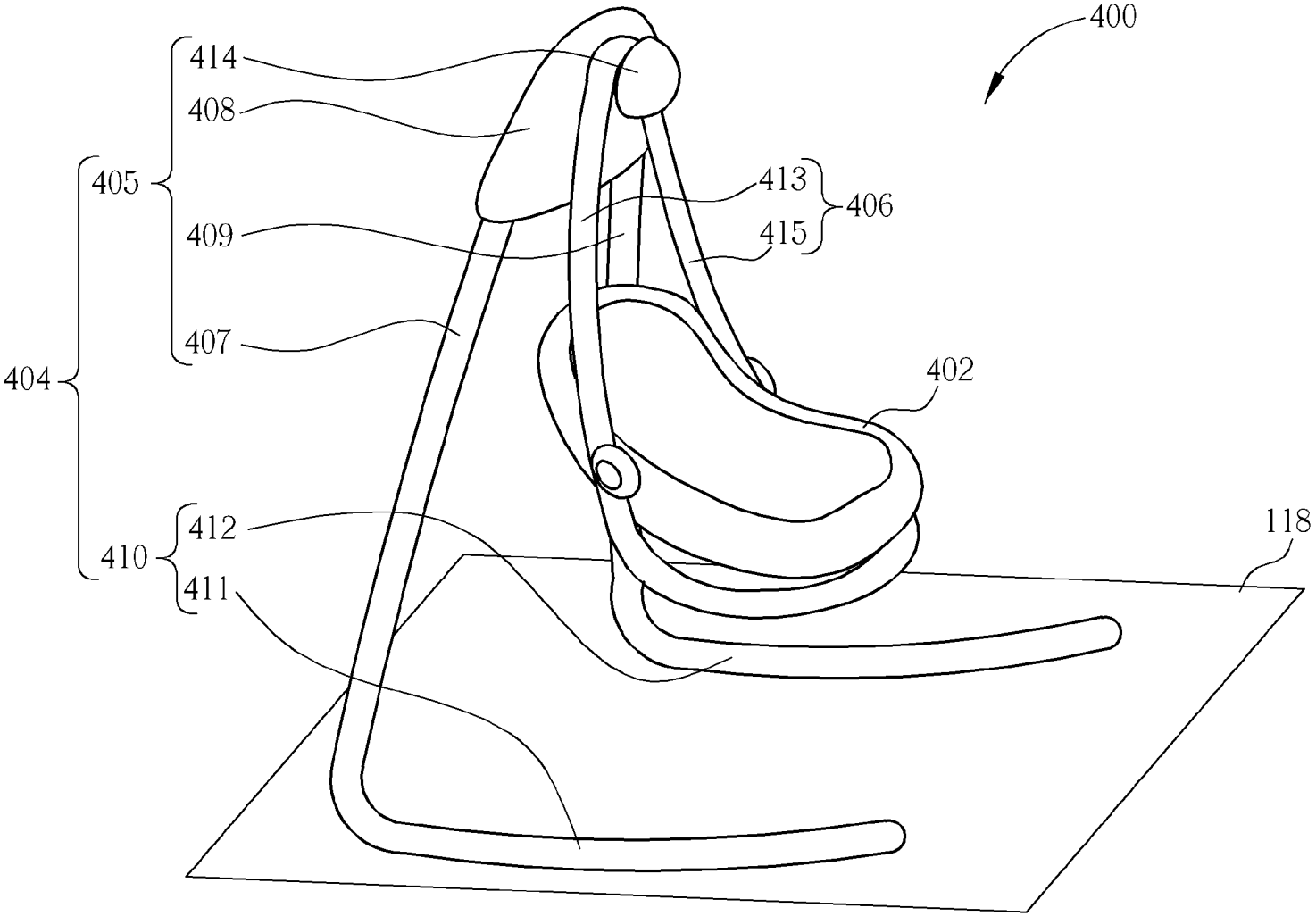
FIG. 5 is a diagram of an infant swing according to a fourth embodiment of the present invention.

Please refer to FIG. 5, which is a diagram of an infant swing 400 according to a fourth embodiment of the present invention. The infant swing 400 includes a holding frame 402, a supporting frame 404 and a hanger 406. As mentioned above, the holding frame 402 is used for holding a baby and is preferably an infant cradle or an infant seat. The supporting frame 404 includes an extending frame 405 and a base 410. The extending frame 405 includes a body portion 408 and two second foot portions 407 and 409 connected to a bottom end of the body portions 408. The two second foot portions 411 and 412 of the base 410 are connected to the corresponding second foot portions 407 and 409 of the extending frame 405, respectively. In this embodiment, the second foot portion 407 and the corresponding first foot portions 411, as well as the second foot portion 409 and the corresponding first foot portion 412, integrally form an L-shaped structure, respectively. The extending frame 405 further includes a connecting part 414 disposed on the body portion 408. The hanger 406 includes a first arm 413 and a second arm 415. The first arm 413 and the second arm 415 are integrally formed and hung at the connecting part 411 of the extending frame 405, so as to support the holding frame 402 on the holding surface 118 cooperatively with the extending frame 405 and the base 410. The hanger 406 can be pushed manually to swing the holding frame 402 leftward and rightward relative to the supporting frame 404. The hanger 406 can also be driven by a motor power-driven device instead. For example, the connecting part 414 can be pivotally connected to the body portion 408 and includes a recess for engaging with the hanger 406 so as to fix the hanger 406 to the connecting part 414. The driving device 108 can be disposed in the body portion 408 for driving the connecting part 414 to rotate, so as to make the holding frame 402 capable of swinging leftward and rightward.

Furthermore, in this embodiment, the first arm 413 and the second arm 415 are preferably pivotally connected to two sides of the holding frame 402, respectively. Therefore, by the said pivotal design, recline angle of the holding frame 402 relative to the first arm 413 and the second arm 415 can be adjusted accordingly, so as to make operation of the infant swing 400 more flexible.

Figure 6:
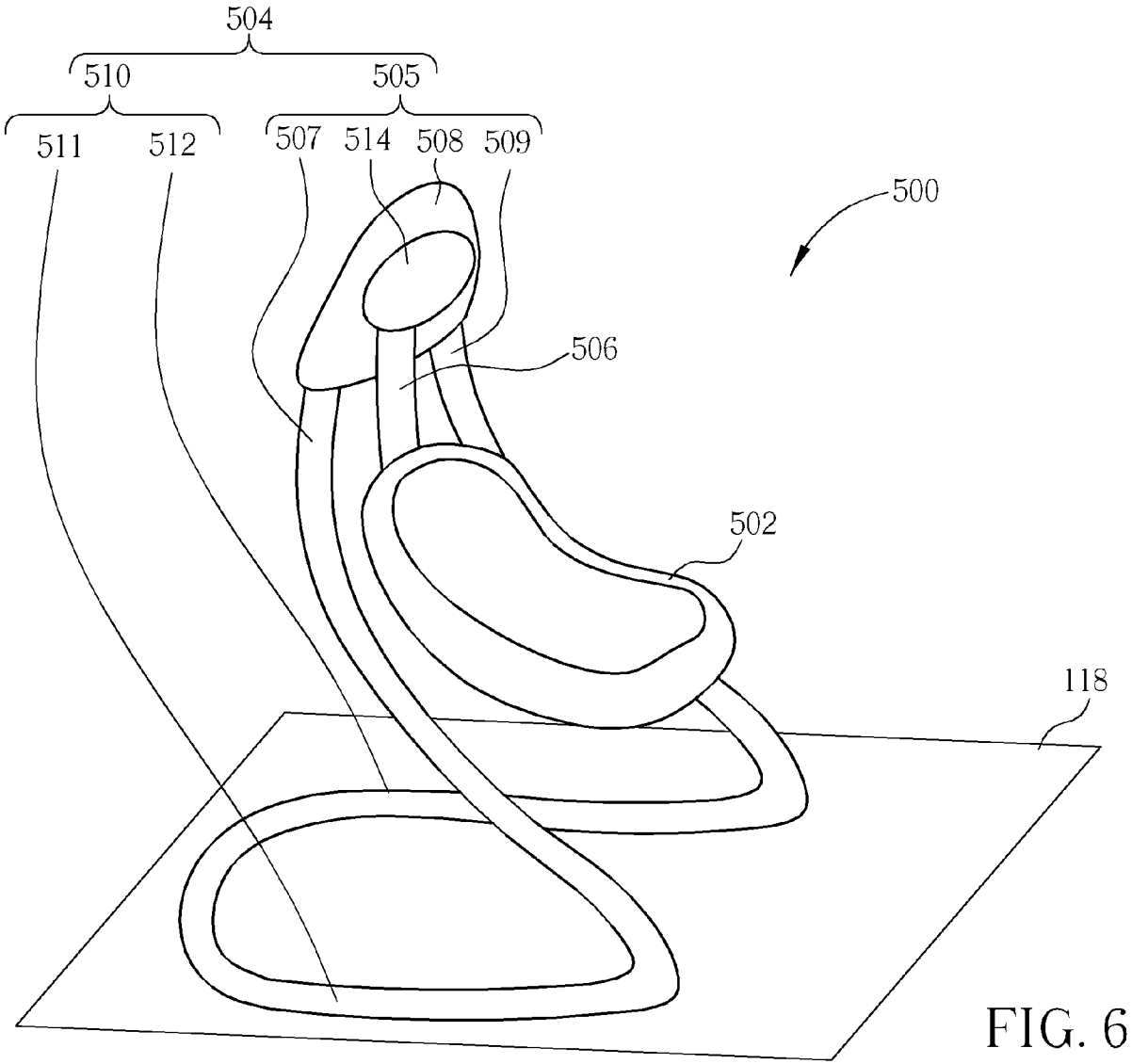
FIG. 6 is a diagram of an infant swing according to a fifth embodiment of the present invention.

Please refer to FIG. 6, which is a diagram of an infant swing 500 according to a fifth embodiment of the present invention. The infant swing 500 includes a holding frame 502, a supporting frame 504 and a hanger 506. As mentioned above, the holding frame 502 is used for holding a baby and is preferably an infant cradle or an infant seat. The supporting frame 504 includes an extending frame 505 and a base 510. The extending frame 505 includes a body portion 508 and two second foot portions 507 and 509 connected to a bottom end of the body portion 508. Two first foot portions 511 and 512 of the base 510 integrally form a U-shaped structure and are connected to the corresponding second foot portions 507 and 509, respectively. In this embodiment, the second foot portions 507 and 509 of the extending frame 505 as well as the corresponding first foot portions 511 and 512 of the base 510 are integrally formed. The extending frame 505 further includes a connecting part 514. The hanger 506 is an arc-shaped rod. A bottom end of the arc-shaped rod is connected to a rear end of the holding frame 502, so that the holding frame 502 can extend forward along the curve of the arc-shaped rod. An upper end of the arc-shaped rod is pivotally connected to the connecting part 514. As for connection of the hanger 506 and the connecting part 514, a conventional swing design commonly seen in the prior art can be used, such as the said active driving design or the said passive driving design mentioned in the above embodiments. As for which design is utilized, it may depend on the practical application of the infant swing 500.

Figure 7:
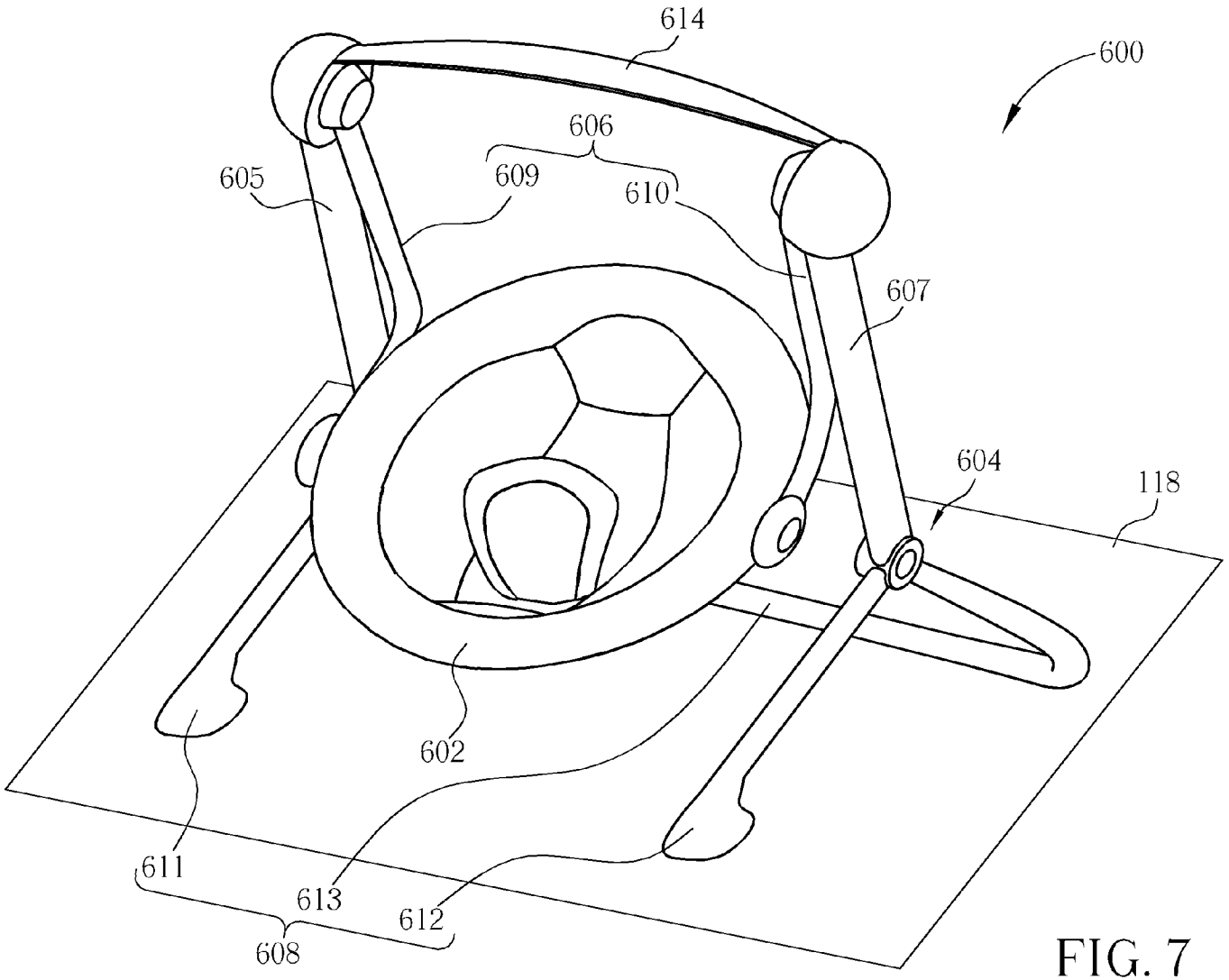
FIG. 7 is a diagram of an infant swing according to a sixth embodiment of the present invention.

Please refer to FIG. 7, which is a diagram of an infant swing 600 according to a sixth embodiment of the present invention. The infant swing 600 includes a holding frame 602, a supporting frame 604 and a hanger 606. As mentioned above, the holding frame 602 is used for holding a baby and is preferably an infant cradle or an infant seat. The supporting frame 604 is a foldable frame set in this embodiment. The supporting frame 604 includes two extending frames 605, 607 and a base 608. The two extending frames 605 and 607 are positioned on two sides of the holding frame 602, respectively. The two extending frames 605 and 607 are pivotally connected to the hanger 606 and extend downward to be connected to the base 608. The hanger 606 includes two arms 609 and 610 which are pivotally connected to the holding frame 602 and the extending frame 605 and pivotally connected to the holding frame 602 and the extending frame 607, respectively, so as to make the holding frame 602 capable of swinging relative to the supporting frame 604. The base 608 contacts with the holding surface 118. The base 608 includes two front feet 611, 612 and a rear foot 613, which are connected to bottom ends of the extending frame 605 and 607 in FIG. 7, respectively. In other words, by assembly of the extending frame 607, the hanger 606 and the base 608, the holding frame 602 can be supported on the holding surface 118 steadily. Furthermore, the rear foot 613, the front feet 611, 612 and the extending frames 605, 607 are pivotally connected, so that the infant swing 600 can be foldable by rotating relative to each other. The related description for the said foldable design is omitted herein since it is commonly seen in the prior art. In addition, as shown in FIG. 7, the infant swing 600 may further include a horizontal rod 614. Two ends of the horizontal rod 614 can be detachably connected to the two extending frames 605, 607, so that the horizontal rod 614 can be located above the holding frame 602. Auxiliary components such as toys, lighting devices, audio devices and so on could be hung or provided at the horizontal rod 614 for being capable of pacifying a baby.

Dispose of the aforementioned auxiliary components, such as the wing part and the lighting device mentioned in the first embodiment, can be applied to the said embodiments, so as to increase the structural variation of the infant swing.

As mentioned above, an infant swing in the prior art can only swing forward and backward and have a squarish structural design, Instead, via the structural design of an extending frame bending along a contour of a holding frame and a hanger to extend upward from a front side of the holding frame to the rear side of the holding frame, as well as the design which can selectively provide a swinging direction of a baby at a leftward-and-rightward or a forward-and-rearward, an infant swing according to the present invention can provide the feeling of sitting similar to a mother's hug so as to make its entire structure more smooth. In such a manner, the infant swing provided by the present invention can not only be compatible with the surroundings, but also enhance its convenience in use since the said problem of blocking parents' or baby's sight can be solved. Furthermore, the infant swing of the present invention can also attract the baby's attention more easily by the design of disposing an auxiliary component (e.g. lighting devices, toys and audio devices) close to or above the holding frame.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An infant swing comprising:

a holding frame for holding a baby;

a hanger connected to the holding frame;

a supporting frame connected to an upper end of the hanger and extending along a contour of the holding frame from a side of the holding frame to another side of the holding frame so as to support the holding frame on a holding surface cooperatively with the hanger, the supporting frame comprising a base and an extending frame, the base contacting with the holding surface, the extending frame being pivotally connected to the hanger and extending downward to be connected to the base; and a first auxiliary component located above a position where the extending frame is pivotally connected to the hanger, the extending frame extending upward from the position where the extending frame is pivotally connected to the hanger to be connected to the first auxiliary component.

2. The infant swing of claim 1, wherein the supporting frame extends from a rear side of the holding frame forward to a front side of the holding frame, so that the holding frame is capable of swinging leftward and rightward relative to the supporting frame.

3. The infant swing of claim 1, wherein the extending frame extends from the side of the holding frame downward to the other side along a curve.

4. The infant swing of claim 3, wherein the hanger comprises an arc-shaped rod, and the arc-shaped rod forms the curve cooperatively with the holding frame.

5. The infant swing of claim 1 further comprising a driving device disposed on a position where the supporting frame is connected to the hanger, the driving device being used for driving the hanger so as to swing the holding frame relative to the supporting frame.

6. The infant swing of claim 1 further comprising:

a second auxiliary component disposed on a position of the extending frame corresponding to the holding frame and below a position where the extending frame is pivotally connected to the hanger.

7. The infant swing of claim 6, wherein the second auxiliary component comprises a wing part, and the wing part comprises two wing portions extending from two sides of the extending frame, respectively.

8. The infant swing of claim 1, wherein the base comprises two first foot portions connected to the extending frame respectively, so as to support the holding frame on the holding surface cooperatively with the extending frame.

9. The infant swing of claim 8, wherein the two first foot portions extend backward from a left side and a right side of a front end of the extending frame, respectively.

10. The infant swing of claim 9, wherein the two first foot portions form a U-shaped structure.

11. The infant swing of claim 1, wherein the hanger comprises:

a first arm and a second arm, connected to two sides of a front end of the holding frame respectively and pivotally connected to two sides of the extending frame respectively.

12. The infant swing of claim 1, wherein the hanger comprises:

a first arm and a second arm, connected to two sides of the holding frame respectively and hung at the extending frame for supporting the holding frame.

13. An infant swing comprising:

a holding frame for holding a baby;

a hanger connected to the holding frame;

a supporting frame connected to an upper end of the hanger and extending along a contour of the holding frame from a side of the holding frame to another side of the holding frame so as to support the holding frame on a holding surface cooperatively with the hanger, the supporting frame comprising a base and an extending frame, the base contacting with the holding surface, the extending frame being pivotally connected to the hanger and extending downward to be connected to the base; and an auxiliary component disposed on a position of the extending frame corresponding to the holding frame and below a position where the extending frame is pivotally connected to the hanger, the auxiliary component comprising a wing part, the wing part comprising two wing portions extending from two sides of the extending frame, respectively.

14. The infant swing of claim 13, wherein the supporting frame extends from a rear side of the holding frame forward to a front side of the holding frame, so that the holding frame is capable of swinging leftward and rightward relative to the supporting frame.

15. The infant swing of claim 13, wherein the extending frame extends from the side of the holding frame downward to the other side along a curve.

16. The infant swing of claim 15, wherein the hanger comprises an arc-shaped rod, and the arc-shaped rod forms the curve cooperatively with the holding frame.

17. The infant swing of claim 13, wherein the base comprises two first foot portions connected to the extending frame respectively, so as to support the holding frame on the holding surface cooperatively with the extending frame.

18. The infant swing of claim 17, wherein the two first foot portions extend backward from a left side and a right side of a front end of the extending frame, respectively.

19. An infant swing comprising:

a holding frame for holding a baby;

a hanger connected to the holding frame; and a supporting frame connected to an upper end of the hanger and extending along a contour of the holding frame from a side of the holding frame to another side of the holding frame so as to support the holding frame on a holding surface cooperatively with the hanger, the supporting frame comprising a base and an extending frame, the base comprising two first foot portions connected to the extending frame respectively and contacting with the holding surface so as to support the holding frame on the holding surface cooperatively with the extending frame, the two first foot portions extending backward from a left side and a right side of a front end of the extending frame respectively, the extending frame being pivotally connected to the hanger and extending downward to be connected to the base.

20. The infant swing of claim 19, wherein the supporting frame extends from a rear side of the holding frame forward to a front side of the holding frame, so that the holding frame is capable of swinging leftward and rightward relative to the supporting frame.

21. The infant swing of claim 19, wherein the extending frame extends from the side of the holding frame downward to the other side along a curve.

22. The infant swing of claim 21, wherein the hanger comprises an arc-shaped rod, and the arc-shaped rod forms the curve cooperatively with the holding frame.

* * * * *